United States Patent [19]

Rodriguez

[11] 4,369,993

[45] Jan. 25, 1983

[54] DOOR LOCKING DEVICE FOR USE WITH INTERCHANGEABLE PADLOCKS

[76] Inventor: Luis A. Rodriguez, 2629 11th St., St. Petersburg, Fla. 33704

[21] Appl. No.: 198,168

[22] Filed: Oct. 17, 1980

[51] Int. Cl.[3] ..... E05B 63/02; E05B 65/06; E05C 1/04; E05C 13/02

[52] U.S. Cl. ..... 292/148; 70/78; 70/129; 70/155; 70/156; 292/DIG. 68

[58] Field of Search ..... 70/133, 134, 129, 154–156, 70/207, 224, 78, 79, 80; 292/148, 150, 336.3, DIG. 68

[56] References Cited

U.S. PATENT DOCUMENTS

| | | | |
|---|---|---|---|
| 467,506 | 1/1892 | Hunter | 70/133 X |
| 911,150 | 2/1909 | McDonald | 70/80 X |
| 2,740,284 | 4/1956 | Gray | 70/79 |
| 2,825,219 | 3/1958 | Marzillier . | |
| 2,912,271 | 11/1959 | Schaeffer | 292/DIG. 68 |
| 3,006,180 | 10/1961 | Walston | 70/153 |
| 3,031,876 | 5/1962 | Foote et al. . | |
| 3,058,334 | 10/1962 | Abelson et al. . | |
| 3,107,513 | 10/1963 | Walston | 292/150 X |
| 3,334,933 | 8/1967 | Ehlers | 292/148 |
| 3,336,769 | 8/1967 | Russell et al. | 70/134 |
| 3,347,069 | 10/1967 | Hollingshead | 70/156 X |
| 3,633,388 | 1/1972 | Atkinson | 70/129 X |
| 3,742,742 | 7/1973 | Foote | 70/78 |
| 3,866,961 | 2/1975 | List | 292/148 X |
| 3,920,297 | 11/1975 | Brandes | 70/78 X |
| 3,945,228 | 3/1976 | Voegeli | 70/80 |
| 4,135,375 | 1/1979 | Voegeli | 70/78 X |
| 4,185,860 | 1/1980 | Bondi | 292/148 |
| 4,290,281 | 9/1981 | Knaack et al. | 70/78 X |

*Primary Examiner*—Cornelius J. Husar
*Assistant Examiner*—Carl F. Pietruszka
*Attorney, Agent, or Firm*—Schuyler, Banner, Birch, McKie and Beckett

[57] ABSTRACT

A locking device (10) for locking a locker (12) is disclosed. A bracket (26) attaches a padlock (50) to the interior surface (36) of a door (18). A latch plate (28) is connected to a shackle (54) of the padlock (50). A handle (30) extends through a slot (58) of the door (18) and is connected to the latch plate (28). A strike plate (34) cooperates with the latch plate (28) and the shackle (54) to lock the door (18).

15 Claims, 5 Drawing Figures

DOOR LOCKING DEVICE FOR USE WITH INTERCHANGEABLE PADLOCKS

TECHNICAL FIELD

The present invention relates to a locking device. The locking device is especially suitable for use with compartments, such as lockers.

BACKGROUND OF THE INVENTION

Numerous types of locking devices are known in the prior art. Both combination and key locks have been used with lockers.

In certain prior art lockers, the body of the locking device has been disposed on the inside of the locker. In such lockers, the locking mechanisms have been specifically designed for the particular locker. Additionally, some of these specifically designed locking mechanisms have been removable from the locker door. Examples of such removable locking mechanisms are disclosed in U.S. Pat. No. 2,740,284 issued to Gray, and U.S. Pat. No. 3,031,876 issued to Foote et al.

Other prior art lockers have utilized conventional padlocks for locking the door of the locker. In lockers of this type, the padlock has been hung external of the door. In one prior art locker a recess is formed in the external surface of the door within which the padlock is hung. Such a locker is shown in U.S. Pat. No. 3,866,961 issued to List.

SUMMARY OF THE INVENTION

The present invention is directed to a locking device for use with a door and jamb. The device includes a means for removably attaching a padlock to an interior surface of a door, a movable handle, means for connecting the handle to the shackle of the padlock, and a strike plate. The handle is adapted to be slidably carried by the door and to be accessible from the exterior surface thereof. The handle is adapted to be passed through a slot in the door whereby the motion of the handle can move the shackle between its locked and unlocked positions. The strike plate is adapted to be connected to a jamb and to cooperate with the shackle of the padlock to prevent the opening of the door when the shackle is locked to the body of the padlock.

In a preferred embodiment, the handle passes through a vertical slot in the door and is connected to a latch plate. The latch plate is held for vertical sliding motion against the interior surface of the door. The latch plate includes a tab extending rearwardly from the major surface of the latch plate. The tab has an aperature through it for receiving a shackle of a padlock. A bracket is removably bolted to the interior surface of the door and is configured to receive the body of the padlock between it and interior surface of the door.

In one embodiment, the strike plate includes an aperture for removably receiving a portion of the shackle to lock and unlock the door to the lamb. In another embodiment, a portion of the latch plate itself cooperates with the jamb to lock and unlock the door.

The present invention provides for the exchangeability of locks with minimal expense. Specifically designed locks need not be used since conventional padlocks can be interchanged. Also, by having the locking device within the locker or door itself, an extremely smooth front face is presented with only the face of the lock and a small handle protruding therefrom.

Various advantages and features of novelty which characterize the invention are pointed out with particularity in the claims annexed hereto and forming a part thereof. However, for a better understanding of the invention, its advantages, and objects obtained by its use, reference should be had to the drawings which form a further part hereof, and to the accompanying descriptive matter, in which there are illustrated and described several embodiments of the invention.

DETAILED DESCRIPTION OF THE INVENTION

Figure 1:
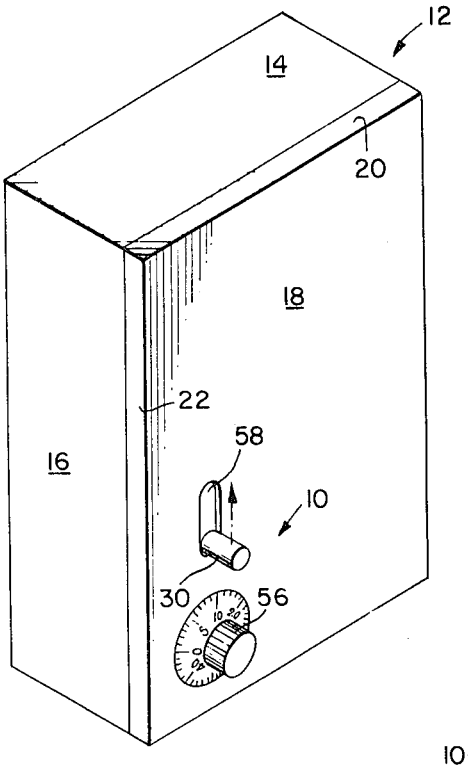
FIG. 1 is a perspective view of a closed locker incorporating a locking device in accordance with the present invention.

Referring to the drawings in detail, wherein like numerals indicate like elements, there is shown in FIG. 1 portions of a locking device in accordance with the present invention designated generally as a 10. The locking device 10 is shown attached to a compartment or a locker 12. The locker 12 includes a plurality of walls, including top wall 14 and side wall 16 shown in FIG. 1. A door 18 is pivotally connected to the side wall opposite side wall 16. The door 18 includes a top edge 20 which extends rearwardly and overlaps a portion of the top wall 14. The door 18 also includes a side edge 22 which extends rearwardly and overlaps a jamb 24, which forms the forward edge of side wall 16.

The locking device 10 includes a holding bracket 26, a latch plate 28, a handle 30, holding means 32 and a strike plate 34.

The bracket 26 is removably secured to an interior surface 36 of the door 18 by means of threaded studs 38 and nuts 40. The studs 38 are fixed, such as by welding, to the interior surface 36 and extend rearwardly threfrom. The bracket 26 includes a pair of connecting flanges 42, 44 each with an aperture for receiving one of the studs 38. The bracket 26 also includes a curved lower portion 46 and a rear plate portion 48.

The bracket 26 removably secures a padlock 50 to the interior surface 36 of the door 18. The padlock 50 includes a body 52 and a shackle 54. The curved lower portion 46 cradles the outer circumferential surface of the body 52 and the rear plate portion 48 holds the body 52 against the interior surface 36. The curved lower portion 46 extends around the circumference of the body 52 for more than 180° to prevent the body 52 from sliding upward. The portion 46 extends to immediately adjacent each leg of the shackle 54. An aperture is formed through the door 18. A combination dial 56 of the lock 50 is exposed through the aperture in door 18 and is operable from the exterior of the locker 12. A key-type lock may be used in place of a combination lock provided the key opening is on the front face of the lock and is exposed through the aperture in the door when the lock is cradled in bracket 26.

The handle 30 is attached to the latch plate 28 and extends through a vertically extending slot 58 in the door 18. The handle 30 is thus also accessible from the exterior of the locker 12.

The latch plate 28 is held for vertically sliding motion by the holding means 32. The holding means 32 includes a flange member comprised of a first vertically extending flange 60 and a second vertically extending flange 62. Each flange 60, 62 includes a portion 64 connected to the interior surface 36 and a guide portion 66 spaced therefrom. The guide portions 66 overlie the opposite vertical sides of the latch plate 28 so that the latch plate 28 is slidably held between the interior surface 36 and the guide portions 66. The latch plate 28 is thereby guided for upward and downward vertical motion.

Figure 2:
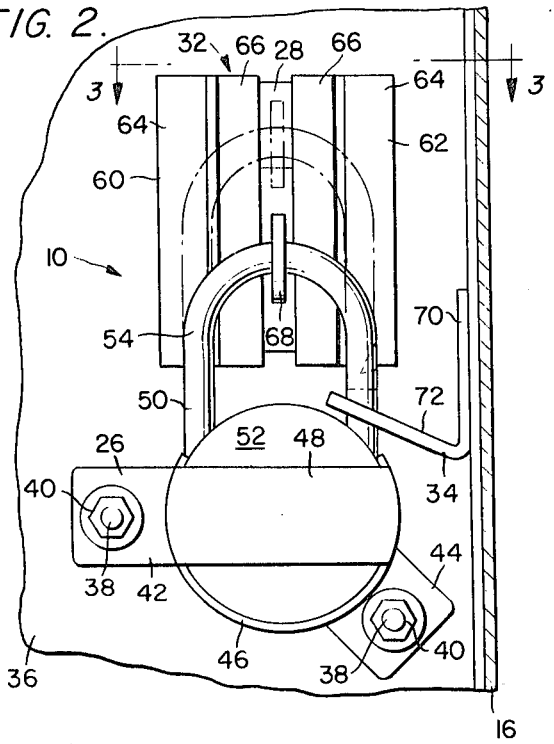
FIG. 2 is a partial rear elevational view of the locker door, partially in section, illustrating a first embodiment of the locking device attached to the interior of the locker.
Figure 3:
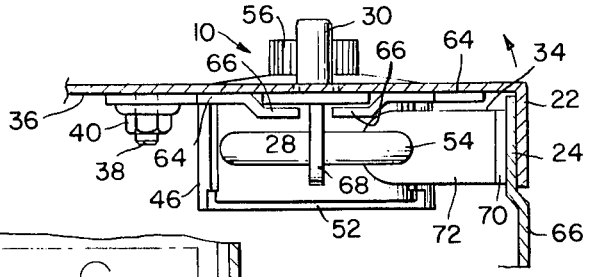
FIG. 3 is a sectional view taken generally along line 3—3 of FIG. 2.

A tab 68 extends rearwardly from the latch plate 28. The tab 68 has aperture through which the shackle 54 is passed. If the shackle 54 is unlocked from the body 52 of the padlock 50, handle 30 is free to move upwardly and downwardly in the slot 58. In this manner the shackle 54 can be moved between its downward locked position (shown in full line of FIG. 2) and its upper unlocked position (shown in phantom line in FIG. 2).

The strike plate 34 has a first portion 70 connected to the jamb 24 and a locking section 72 extending therefrom laterally inward to a position above a portion of the body 52 of the lock 50. The locking section 72 has an aperture through which a portion of the shackle 54 can pass to thereby lock and unlock the door 18. A major surface of the locking section 72 is disposed transverse to the plane of the interior surface 36 of the door 18.

When the shackle 54 is in its locked positioned and a person wishes to open the locker 12, the combination is dialed to unlock the shackle 54 from the body 52. If a key type padlock is used, the shackle is unlocked with the key. Thereafter, the handle 30 is moved upward until the shackle 54 is free of the locking section 72 of the strike plate 34. The door 18 can then be opened.

Figure 4:
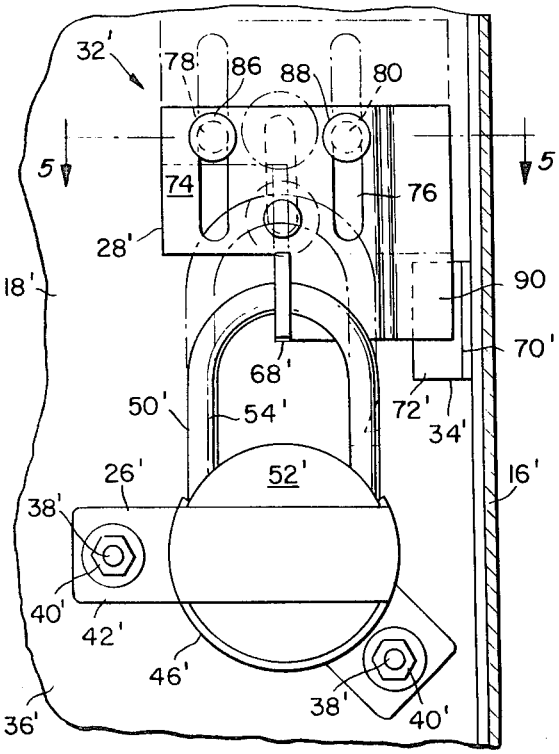
FIG. 4 is partial rear elevational view of a locker door, partially in section, illustrating a second embodiment of the locking device attached to the interior of a locker.
Figure 5:
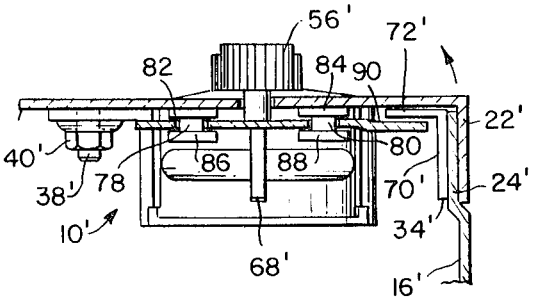
FIG. 5 is a sectional view taken generally along line 5—5 of FIG. 4.

A second embodiment of a locking device in accordance with the invention, indicated generally as 10' i shown in FIGS. 4 and 5. Like elements in the two embodiments are indicated by like numerals, with those in the second embodiment being primed. The locking device 10' operates in a manner similar to the locking device 10 except that the latch plate 28', the connecting means 32', and the strike plate 34' are constructed differently.

The latch plate 28'has a pair of spaced vertically extending slots 74, 76. A pin 78 is attached to the interior surface 36' and extends through the slot 74, and a pin 80 is attached to the interior surface 36' and extends through the slot 76. Each pin 78, 80 has a diameter slightly less than the width of slots 74, 76. The pin 78 extends from a plate or disk 82 which is attached to the interior surface 36'. The pin 80 extends from a plate or disk 84 which is attached to the interior surface 36'. A circular plate or disk 86 is attached to the free end of the pin 78, and a circular plate or disk 88 is attached to the free end of the pin 80. The plate 86 and the plate 88 each have diameter greater than the width of the respective slots 74, 76. In this manner, the latch plate 28' is held between two pair of plates, i.e. between plates 82, 86 and plates 84, 88. The latch plate 28' thus can be slid vertically up and down.

The locking section section 72' of the strike plate 34' has a major surface which extends generally parallel with the interior surface 36'. The latch plate 28' includes a locking portion 90 which extends laterally toward the side wall 16 and slightly rearward or inward of the locking section 72' of strike plate 34' with the door 18' in its closed position. When the latch plate 28' is in its lower position, the locking portion 90 overlaps the locking section 72' to thereby hold the door 18' shut. When shackle 54' is unlocked from the body 52', the latch plate 28' can be raised to the position shown in phantom line in FIG. 4. In such a position, the locking portion 90 is disposed above the locking section 72' and the door 18' is free to swing open.

Numerous characteristics and advantages of the invention have been set forth in the foregoing description, together with details of the structure and function of the invention, and the noveal features thereof are pointed out in the appended claims. The disclosure, however, is illustrative only, and changes may be made in detail, especially in matters of shape, size, and arrangement of parts, within the principal of the invention, to the full extent indicated by the broad general meaning of the terms in which the appended claims are expressed.

I claim:

1. A locking device for a door and jamb, for use with a padlock having a body, a shackle slidable in the body between locked and unlocked positions, and an actuator on one face of the body for unlocking the shackle, the device comprising:

means for removably attaching the padlock to the interior surface of the door with a portion of the actuator face of the padlockexposed through an aperture in the door;

a handle slidably carried by the door and accessible from the exterior thereof;

means for connecting said handle to the shackle of the padlock whereby the motion of said handle can move the shackle between its locked position and its unlocked position; and a strike plate connected to the jamb and cooperating with the shackle of the padlock to prevent the opening of the door when the shackle is locked to the body of the padlock.

2. A locking device in accordance with claim 1 wherein said attaching means includes a bracket removably secured to the interior surface of the door.

3. A locking device in accordance with claim 2 wherein said bracket includes a curved lower portion for holding a curved bottom of the body of the padlock and a rear plate portion spaced from the interior surface of the door for positioning and holding the body of the padlock between said rear plate portion and the interior surface of the door.

4. A locking device in accordance with claim 1 wherein said connecting means is comprised of a latch plate, and including means for supporting said latch plate for sliding motion along the interior surface of the door, said handle being connected to said latch plate and extending therefrom through a slot in the door, and the shackle being removably connected to said latch plate.

5. A locking device in accordance with claim 4 wherein said latch plate includes a major plate held by said supporting means parallel to the interior surface of said door and a tab extending from said major plate away from the interior surface of the door, said tab having an aperature for receiving the shackle of the padlock.

6. A locking device in accordance with claim 5 wherein said supporting means includes a flange member extending from the interior surface of the door on either vertical side of the latch plate, said tab extending from said latch plate through a space between said flange members, each flange member having a guide portions spaced from the interior surface of the door and extending vertically, said latch plate being supported for vertical motion between said guide portions and the interior surface of said door.

7. A locking device in accordance with claim 6 wherein said strike plate extends from the jamb to an area behind the interior surface of the door and adjacent the body of the padlock where the shackle is removably connected thereto, said strike plate having an aperture through which said shackle can be passed to lock and unlock the door to the jamb.

8. A locking device in accordance with claim 5 wherein said supporting means includes a pair of horizontally spaced pins attached to and extending from the interior surface of the door, said latch plate having a pair of vertically extending slots, one of said pins being received in one of said slots and the other of said pins being received in the other of said slots, and means for holding said latch plate to said pins to hold and guide said latch plate for vertical motion.

9. A locking device in accordance with claim 8 wherein said strike plate extends from the jamb to an area behind the interior surface of the door, a locking portion of said latch plate being disposed behind said stirke plate to lock the door when the shackle is locked to the body of the padlock and disposed above said strike plate when the handle moves said latch plate upward to move the shackle to its unlocked position.

10. A device for removably attaching a padlock to the interior of a locker with a portion of the actuator face of the padlock exposed through an aperture in the door of the locker, comprising:

a bracket removably attached to an interior surface of the door of the locker, said bracket being configured to removably hold a padlock between itself and the interior surface of the door;

a latch plate;

means for supporting said latch plate or the interior surface of the door for vertical movement;

a handle connected to said latch plate and adapted to extend out of the locker;

a tab extending from said latch plate and having an aperture for receiving a shackle of the padlock; and a strike plate attached to an interior side of the locker to cooperate with said latch plate and the shackle to lock the door.

11. A device in accordance with claim 10 wherein said bracket includes a curved lower portion for cradling the curved bottom portion of the body of the padlock and a rear plate portion for holding the back of the body of the padlock to the interior surface of the door.

12. A device in accordance with claim 10 or 11 wherein said supporting means includes a first vertically extending flange attached to the interior surface of the door and having a guide portion spaced from the interior surface of the door to slidably support a first vertical edge of the latch plate between the guide portion and the interior surface of the door, and a second vertically extending flange attached to the interior surface of the door and having a guide portion spaced from the interior surface of the door to guide a second vertical edge of the latch plate in between the last-mentioned guide portion and the interior surface of the door, said strike plate having a locking section with a major surface transverse to the interior surface of the door extending to an area between the shackle and the location where it locks to the body of the padlock and having an aperture through which the shackle can pass.

13. A device in accordance with claim 10 or 11 wherein said supporting means includes a first pin extending inward from the interior surface of the door and passing through a vertically extending slot in the latch plate and a second pin extending inward from the interior surface of the door and passing through a second vertically extending slot in said latch plate, a disk being attached to a free end of each of said pins, each disk having a transverse dimension greater than the width of the respective slot to thereby hold the latch plate between the disk and the interior surface of the door, said strike plate having a locking section extending inwardly from the interior surface of the side wall of the locker and having a major surface generally parallel to the interior surface of the door, and said latch plate having a locking portion disposed behind the locking section of said strike plate when the shackle is locked to the body of the padlock.

14. A locking device in accordance with claim 11 wherein said lower portion of said bracket has a circumferential extent greater than 180° with opposite ends adapted to be adjacent the legs of the shackle to prevent a vertical motion of the body of the padlock.

15. A locking device for use with a combination padlock for locking a door of a locker comprising;

a bracket removably attached to the interior surface of the door of the locker, said bracket having a lower curved portion to cradle the circumferential surface of the body of the padlock and a rear plate to hold the body of the padlock to the interior surface of the door with the dial portion of the padlock exposed through an aperture in the door, the aperture being less than the total diameter of the body of the padlock;

a latch for sliding vertical motion with respect to the interior surface of the door, said latch plate including a tab extending inward therefrom and having an aperture for receiving the shackle of the padlock;

means for supporting said latch plate on the interior surface of the door for vertical movement;

a handle extending outward from said latch plate through a vertical slot in the door; and a strike plate attached to an interior side surface of the locker and having a locking section extending laterally inward behind the interior surface of the door, said locking section cooperating with the shackle and said latch plate to lock the door of the locker.

* * * * *